United States Patent [19]

Backteman

[11] 3,992,050

[45] Nov. 16, 1976

[54] SPREADER FRAME

[76] Inventor: Hans Ulrick Backteman, Lusthusbacken 14, Bromma, Sweden

[22] Filed: June 3, 1975

[21] Appl. No.: 583,253

[30] Foreign Application Priority Data

June 5, 1974 Sweden ..... 74074253

[52] U.S. Cl. ..... 294/81 SF; 105/366 B; 105/465; 214/620; 296/35 A; 294/67 DA; 248/119 R

[51] Int. Cl.[2] ..... B66C 1/00

[58] Field of Search..... 294/67 R, 81 SF, 67 DA; 248/361 R, 509, 119 R; 105/366 B, 366 C, 463, 464, 465; 24/221 R; 296/35 A; 214/620, 621, 394

[56] References Cited

UNITED STATES PATENTS 3,453,017 7/1969 Nagy ..... 296/67 R 3,892,436 7/1974 Fathauer ..... 294/81 SF

*Primary Examiner*—James B. Marbert

*Attorney, Agent, or Firm*—Spencer & Kaye

[57] ABSTRACT

A spreader device for handling containers is provided with a substantially flat bottom surface in its non-operative condition. A swingable arm mechanism is provided at each end of the spreader, and when the spreader is properly located on top of a container the swingable arm mechanism is moved to extend twist-locks out from the interior of the spreader and insert said twistlocks into the top holes of the upper corner castings of the container. Power means are provided for the operation of the swingable arm and for turning the twistlocks into an inter-connecting position when located within the corner casting.

4 Claims, 2 Drawing Figures

SPREADER FRAME

Figure 1:
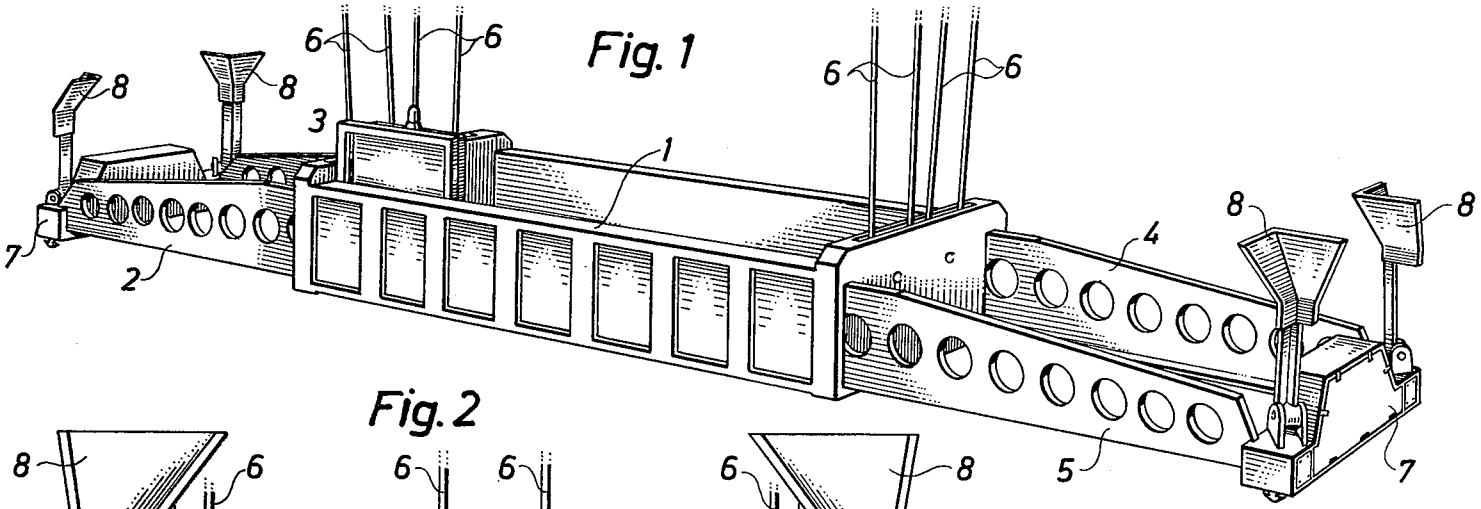

The present invention relates generally to lifting equipment for standardized containers, and the invention relates especially to a spreader or lifting frame for handling containers.

Within the transportation technique it has during recent years to an ever increasing extent been a common habit to use containers for transportation of goods from the location of the manufacturer or dealer to the consumer or user in the same container, and the containers may hence be carried upon road vehicles as well as by railway, by air, but mainly upon ships. Due to this fact several handling occasions occur for the containers in connection with for instance reloadings. In that connection, the people within this technical field have used spreaders or lifting frames for the intended handling of the containers. This type of spreader generally comprises a central frame unit supported for instance by a crane with the aid of cables or the like. Beams extended from the central frame in opposite directions, with the terminal or outer ends of the beams being connected to each other in pairs by the means of transverse or cross beams. The beams extending from the central frame may be telescopically movable in an inward and outward direction for adjustment of the mutual distance between the two transverse or cross beams. The transverse or cross beams are each provided with two depending twistlocks, which are to be inserted in the top hole of the upper corner castings or boxes of the container and when the twistlocks are properly located within the corner castings they are turned so that their locking heads will extend transversely in relation to the extension of the top hole of the corner casting. Thereby, the twistlock will abut the upper inner surface of the corner casting during lifting of the spreader and the container will move together with the spreader. At the outer terminal edges of the transverse or cross beams so-called corner-sensing arms may be located, so that when the spreder is to be placed upon a container the arms are swung down and constitute adjustment means, damping the swinging movement of the spreader and causing the spreader to be located upon the container in the correct position for insertion of the twistlocks into the container corner boxes. However, since the spreaders are big and heavy devices, it happens that inspite of the presence of the corner-sensing arms the spreaders have not been completely brought into rest from their swinging movement when they approach the container, and experience has shown that several containers have been damaged due to the fact that the twistlocks of the spreader in connection with lowering the spreader onto the container have been locked beside the corner casting and the twistlocks have driven through the upper side of the container and produced holes therein. When such damaged containers then are transported for instance on ships, salt water and air that now may enter into the container through the holes thus produced will result in the contents of the container being corroded or damaged in another way. The risk of such damages produced due to the fact that the twistlocks have broken through the roof of the container has among other things resulted in many container manufacturers finding it necessary to reinforce the roof of the container in the areas around the upper corner boxes, which, of course, has resulted in the fact that the container has become firstly more expensive and secondly heavier. One illustrative example of such an earlier type of spreader is the one described in the British Patent Specification No. 1,144,626.

A primary object of the present invention is to avoid the above-mentioned damages on the upper sides of the container. This object or aim in accordance with the present invention is achieved by the fact that the bottom side of the spreader has been made completely flat, since the twistlocks located at the corner portions of the spreader are arranged in a withdrawable manner into the beams of the spreader.

Some attempts have been made in order to provide withdrawable twistlocks, as for instance has been described in the Swedish Patent Application No. 7878/69. However, the withdrawal or retracting mechanism for that type of withdrawable or retractable twistlocks with a hydraulic cylinder vertically located above the twistlock and positioned completely aligned in relation thereto, and thereby the corner portions of the spreader became very high, since they had to partly accomodate the vertically extending hydraulic cylinders and partly accomodate the complete length of the twistlock in its withdrawn or retracted position. Due to this great height of the corner portions, the sensing arms had to be made substantially longer than in those cases wherein stationary twistlocks were used. Due to their extended length dimension the sensing arms could more easily be deformed by the stresses exerted in connection with the adjustment of the spreader upon the container. Other drawbacks relating to the previously known withdrawal or retracting mechanisms were a complicated manufacture resulting in the fact that the manufacturing costs, of course, were increased and that already existing spreaders could not be provided in a simple way with such withdrawable or retractable twistlocks except when very extensive rebuilding operations were carried out.

The present invention has as one of its objects or aims to eliminate these drawbacks of the earlier known spreaders having withdrawable or retractable twistlocks, and in accordance with the present invention a spreader is obtained, that due to the fact that the twistlocks are insertable into the beams of the spreader exhibits a flat bottom surface in connection with lowering onto a container, and the spreader according to the invention has a simple and non-complicated withdrawal or retracting mechanism for the twistlock, which in addition to making the manufacture of a spreader having withdrawable or retractable twistlocks less expensive also permits mounting within the transverse or cross beams of already existing spreaders without the need of any substantial modification thereof. In addition to the above facts it is in accordance with the present invention possible to maintain the low height dimension of the transverse or cross beams at the outer portions thereof, and hence, the sensing arms of the spreader may be manufacturers with substantially unchanged length.

The above-mentioned objects and aims of the invention are achieved in connection with a spreader according to the opening part of the enclosed claim by using the improvement features according to the claims.

An embodiment of the present invention will as an illustrative example of the general conception of the present invention below be described in detail with reference to the attached drawings illustrating the embodiment of the invention and wherein FIG. 1 in a perspective view illustrates a spreader according to the invention, and FIG. 2 in an elevational end view illustrates the spreader according to the invention, wherein the cover or protective plate of the transverse or cross beams has been partly broken away in the right part of the figure in order to clearly illustrate some internally located structural details.

The spreader illustrated on the drawings comprises a central frame 1 and telescopically protrudable and retractable side beams 2, 3, 4 and 5. The spreader may be lifted by cables 6. Transverse or cross beams 7 are located at the outer portions of the side beams, one of the transverse or cross beams being illustrated in detail in FIG. 2. Sensing arms 8 are provided on top of the outer portions of the transverse or cross beams, with the sensing arms 8 being mounted in a downwardly swingable manner around pivots 9, and with the swinging movement being carried out by a motor 10 and a power transmission device 11. Twistlocks 12, 13 (cf. FIG. 2) are also provided at the outer portions of the transverse or cross beams, the twistlocks 12, 13 being intended for interlocking the container to the spreader. The twistlock 12 is turned into or out of, respectively, its locking position by a hydraulic cylinder 14, being illustrated in FIG. 2 by broken lines.

Figure 2:
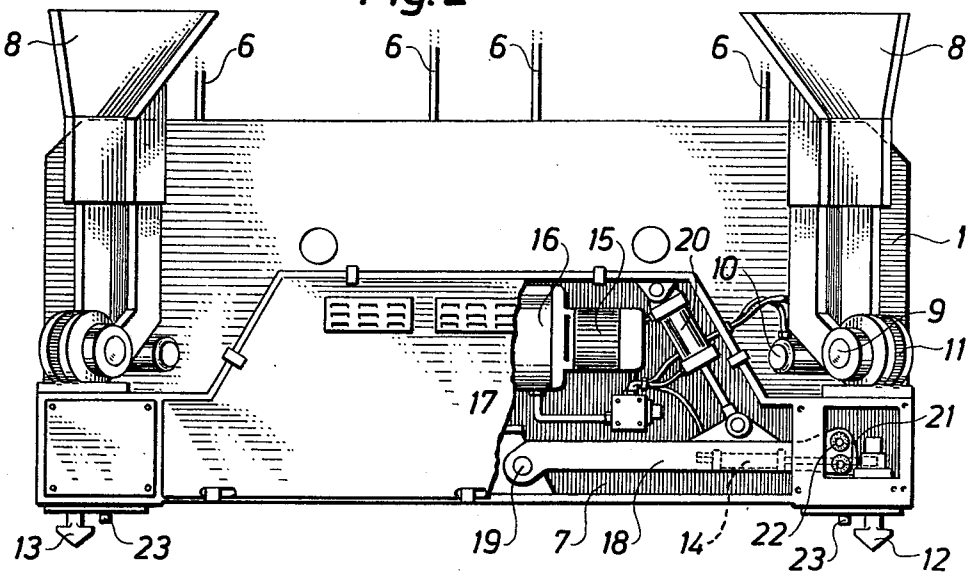

The right portion of FIG. 2 illustrates the structural elements located inside the cover or protective plate, and it is realized that a corresponding mechanism for withdrawal or retracting the left twistlock 13 is provided behind the cover or protective plate of the transverse or cross beam, but is not illustrated in the drawing. An electric motor 15 operates to pressurize a hydraulic oil tank 16, to which tank oil conduits are connected. The oil conduits extend from the hydraulic oil tank 16 to control means or valves 17, being actuatable to provide the different individual devices powered in a hydraulic manner with pressurized hydraulic oil. A swingable arm 18 is mounted in a swingable way at the central portion of the transverse or cross beam at a swinging point or pivot 19, and the other end portion of the swingable arm 18 is mounted to the twistlock 12. The swingable arm 18 may be turned or pivoted upwardly or downwardly around the pivot 19 by the aid of the hydraulic cylinder 20, and it is realized that the twistlock 12 thereby moves together with the swingable arm 18 and hence, when the swingable arm 18 turns upwardly, the twistlock 12 will be moved upwardly to be accomodated completely within the interior of the side beam. An aperture is made in the bottom surface of the outer edge of the side beam, in which aperture the twistlock will be located when the swingable arm 18 has been turned down into the position illustrated in FIG. 2. The twistlock 12 is connected to the swingable arm 18 by a mounting head 21, attached to the swinging arm 18 by for instance elastic bushings or bearings 22. The mounting head 21 may be mounted to the twistlock 12 by for instance bolt means. As mentioned above, the twistlock 12 may be turned by the turning hydraulic cylinder 14 illustrated by broken lines.

The function of the spreader according to the present invention is as follows. When the spreader is to be placed upon a container, it is lowered down toward the container by the aid of the cables 6, supported or carried by for instance a crane. The twistlocks 12, 13 are at that time completely withdrawn or retracted into the transverse or cross beams 7 and, therefore, the spreader is exposing a completely flat bottom surface.

When the spreader approaches the container, the sensing arms 8, in case sensing arms are provided, are turned down, and when the spreader contacts the roof of the container security locks or guards 23 are depressed. Then, the hydraulic cylinder 20 of the swingable arm 18 may be actuated to swing down the swingable arm 18, so that the twistlock 12 is moved out of the interior of the transverse or cross beam and down into the upper corner casting of the container. The twistlock may then be turned into its locking position by the hydraulic cylinder 14 and the container is connected and locked to the spreader.

By the provision of the swingable arm 18 the twistlock 12 will move along an arc into and out of the transverse or cross beam space and hence, the necessary space volume for accomodation of this operation may be substantially decreased in relation to that of the earlier known constructions, and due to this decreased demand of space the outer portions of the transverse or cross beam may maintain a very low height dimension and the sensing arms may be made shorter and accordingly stronger. Thereby, it is possible to mount the new swingable arrangement for the twistlocks according to the invention also in already existing spreaders without the need for any substantial modifications thereof. The hydraulic cylinder 20 intended for the withdrawal or retraction of the twistlock 12 into the transverse or cross beam may be located at any point along the transverse or cross beam where sufficient space already exists, for instance in connection to other devices, such as for instance an electric motor, a hydraulic oil tank, hydraulic valves, etc., where sufficient space is available. The turning cylinder 14 for the twistlock 12 is suitably mounted upon the swingable lifting arm 18, whereby the space demand is decreased and the construction is simplified and possible to manufacture at a lower cost.

It is realized that the above described and on the attached drawing illustrated construction may be modified and changed within the frame of the enclosed claims. Of course, it is additionally possible that further details or elements are provided, for instance additional security guards or derrick limit switches operating either in a mechanical or electrical way in order to permit certain functions automatically to be carried out when activated, which means that the operation or manipulation of the spreader is facilitated. For instance, in connection with lifting a security guard may be protruded by spring force into a gap occurring between the spreader and the upper portion of the container blockading the possibility of inadvertent release of the turning movement of the twistlock, whereby inadvertent release of the twistlock is avoided and the container cannot be dropped.

What I claim is:

1. A spreader device for handling containers and comprising a central frame and side beams extending therefrom, said side beams at their outer portions being connected in pairs to each other by transverse or cross beams, said spreader also comprising twistlocks being movable into and out of said transverse or cross beams, wherein said twistlocks are movable between a protected positon within the transverse or cross beams and a container coupling position wherein the twistlocks protruded from the transverse or cross beams, the improvement wherein said movement is performed along arcs by a swingable arm mechanism comprising a swingable arm pivotably journalled at one end thereof and at its other end connected to said twistlock, and a pivotably mounted driving device located along the swingable arm between the ends thereof for moving said swingable arm and hence said twistlock.

2. A spreader according to claim 1, wherein said driving device for moving the swingable arm is a pivotably mounted hydraulic cylinder mounted in a suitable place along the extension of the swingable arm and connected between said swingable arm and a mounting device provided in the transverse or cross beam.

3. A spreader according to claim 1, wherein said swingable arm moving the twistlock into and out of the transverse or cross beam also supports a device for turning the twistlock into its locking position when the twistlock is inserted into the top hole of the upper corner casting of a container.

4. A spreader according to claim 1, wherein said twistlock is only possible to be swingably moved downwardly from its protected position within the transverse or cross beam when a security guard has been depressed into the transverse or cross beam in connection with placing the spreader onto a container and when a blockading effect on the swinging movement has been abolished.

* * * * *